United States Patent [19]

Scheibe

[11] 4,303,814

[45] Dec. 1, 1981

[54] GAS-BLAST POWER SWITCH

[75] Inventor: Klaus Scheibe, Salzgitter, Fed. Rep. of Germany

[73] Assignee: Licentia Patent-Verwaltungs-G.m.b.H., Fed. Rep. of Germany

[21] Appl. No.: 15,941

[22] Filed: Feb. 28, 1979

[30] Foreign Application Priority Data

Mar. 6, 1978 [DE] Fed. Rep. of Germany ..... 2809509

[51] Int. Cl.[3] ..... H01H 33/88

[52] U.S. Cl. ..... 200/147 R; 200/147 A; 200/148 A

[58] Field of Search ..... 200/147 A, 148 A, 147 R, 200/144 B

[56] References Cited

U.S. PATENT DOCUMENTS

| | | | |
|---|---|---|---|
| 3,014,108 | 12/1961 | Cobine et al. | 200/147 A |
| 3,014,109 | 12/1961 | Burger | 200/147 A |
| 3,082,308 | 3/1963 | Baker | 200/147 A |
| 3,991,292 | 11/1976 | Perkins | 200/148 A |
| 4,079,219 | 3/1978 | Weston | 200/148 A |
| 4,082,932 | 4/1978 | Rozier et al. | 200/148 A |

*Primary Examiner*—Robert S. Macon

*Attorney, Agent, or Firm*—McGlew and Tuttle

[57] ABSTRACT

A power switch in which an arc is produceable in an arc area between electrodes which are moved apart upon opening the switch comprises a fixed electrode forming one electrode for the power switch and a movable electrode forming the other electrode of the power switch movable into and out of contact with the fixed electrode. A space is produced between the fixed and movable electrodes which forms an annular arc area. A magnetic field producing coil is positioned annularly about the arc area and is energized to form a magnetic field when the movable electrode is disengaged from the fixed electrode to produce a rotation of the arc formed between the two electrodes in the annular arc area. A driving device is connected to the movable electrode for moving it away from the fixed electrode and the movable electrode includes a piston portion which is movable into a compression chamber. The compression chamber includes at least one bore directed toward the annular arc area. An arc quenching gas is contained within the compression chamber and displaced through the opening when the movable contact is moved away from the fixed contact to blow the gas transversely across an arc produced in the annular arc area.

7 Claims, 2 Drawing Figures

GAS-BLAST POWER SWITCH

BACKGROUND OF THE INVENTION

1. Field of the Invention

The present invention relates in general to power switches and in particular to a new and useful gas-blast power switch which includes means for directing a flow of arc quenching gas transversely across an arc produced between contacts of the switch.

2. Description of the Prior Art

In power switches, a common problem is the formation of an electric arc between a fixed contact of the switch and a movable contact which is moved away from the switch in order to open the switch. Known power switches include means for removing energy from the arc in order to extinguish it which comprise driving the arc in a rotational direction in the presence of a pressurized gas which is usually sulphur hexafluoride ($SF_6$). In this way it is possible to extinguish the arc at the zero passage. In a prior art switching device of this kind (ELEKTRIE, No. 10, 1967, page 364) the electrodes contact each other in the "switch on" or closed position. To turn the switch to its "switch off" or open position, the inner electrode which forms a cylindrical contact is brought into a concentric position relative to the outer contact which forms an annular contact. An annular gap is thereby formed between the two contacts and an arc formed in this annular gap is driven into a rotational motion by a coaxial blowout coil which is permanently provided in the circuit up to the time the arc is extinguished.

Another prior art switch, (German Offenlegungsshrift No. 43 49 193) comprises two chambers of unequal volume. A rotating auxiliary arc is drawn in the smaller chamber during this connection of the switch for the purpose of producing pressure in a gas contained in the smaller chamber. Heated gas from the small chamber is then displaced through a nozzle made of insulating material and into the larger chamber. An arc extinction is thereby effected in a well-known manner by a gas jet from the nozzle. No blowout coil is provided in this structure.

SUMMARY OF THE INVENTION

The present invention is directed to a power switch in which the concept of quenching by means of a rotating arc is used and applied to a conventional switch comprising an axially movable tripping pin with the addition of means for providing an extinguishing blast.

Accordingly, an object of the present invention is to provide a power switch in which an arc is producable in an arc area between electrodes which are moved apart comprising, a fixed electrode, a movable electrode movable into a contact position contacting the fixed electrode and into an open position spaced from the fixed electrode, the space between the movable and fixed electrodes forming an annular arc area, switch opening means connected to the movable electrode for moving it away from the fixed electrode, means defining a compression chamber for containing an arc quenching gas associated with the movable electrode, the movable electrode including a piston portion movable into the compression chamber for displacing gas therein, and gas flow passage means in said means defining a compression chamber for directing the displaced gas across an arc formed in the annular arc area.

A further object of the present invention is to provide a method of quenching an arc formed between contacts of a power switch comprising rotating the arc using a magnetic field, providing a movable electrode which moves away from a fixed electrode to open the switch, displacing an arc quenching gas using the movement of the movable electrode, and directing the displaced arc quenching gas into a flow path flowing across the arc.

Another object of the present invention is to provide a gas blast power switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
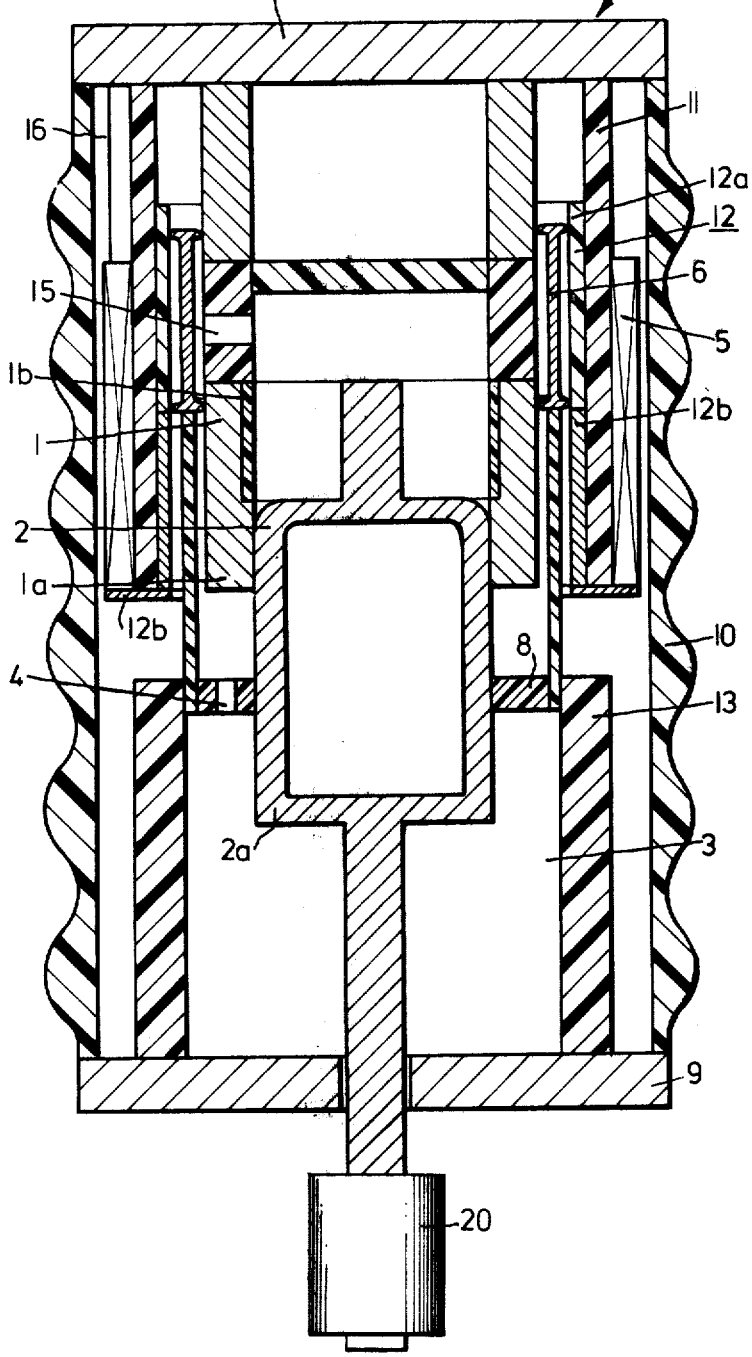
FIG. 1 is a cross-sectional side elevational view of the power switch in accordance with the invention.

Referring to the drawings, the invention embodied therein in FIG. 1 comprises a gas-blast power switch generally designated 50 having a fixed contact 1 and a movable contact 2 movable into and out of contact with the fixed contact 1 with a switch opening means 20 which is of any conventional design to effect a downwardly axial movement of movable electrode 2 as shown in FIG. 1. When the switch is open as shown in FIG. 2, an annular arc area 30 is formed in which an arc 14 is produced.

Figure 2:
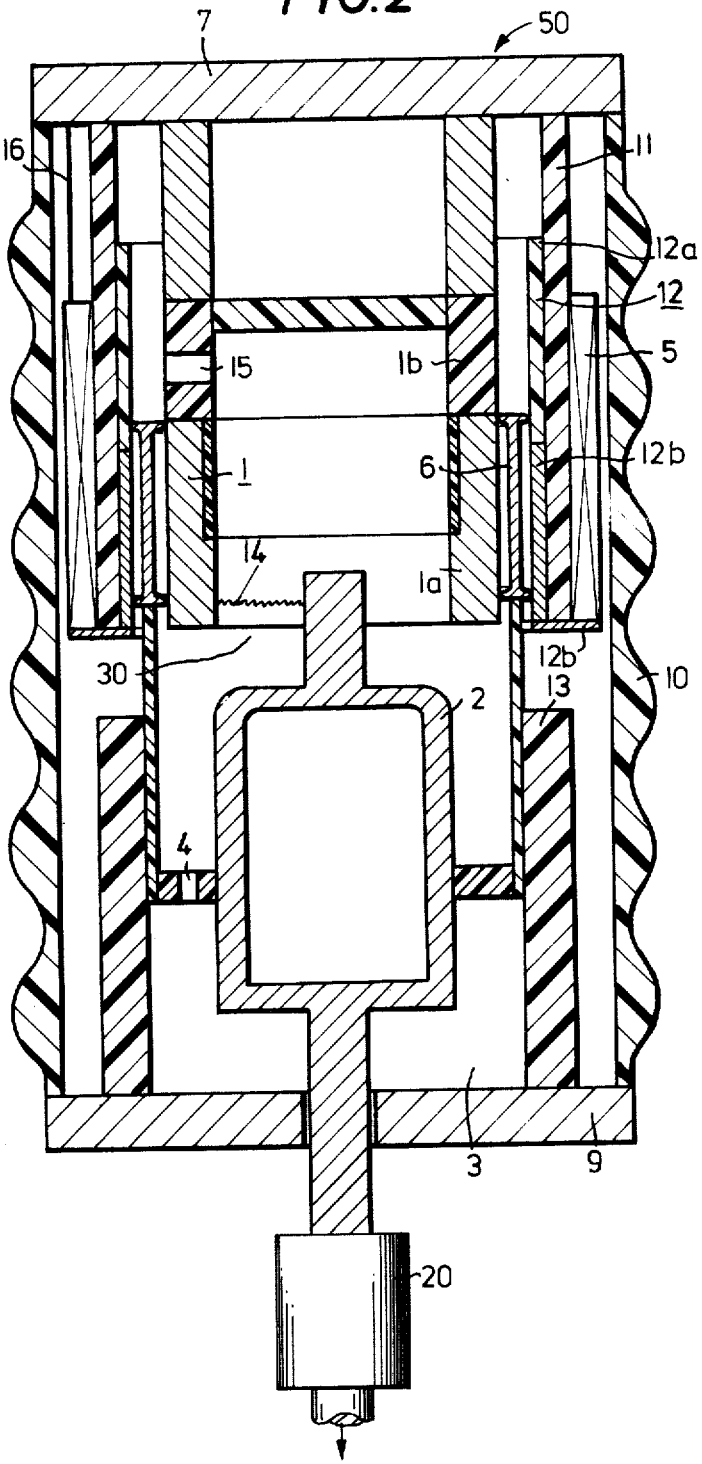
FIG. 2 is a view similar to FIG. 1 showing the switch in its open position.

The switch shown in FIGS. 1 and 2 comprises terminal or switch contact parts 7, 9 forming, at the same time, the end portions of a cylindrical housing 10 of insulating material. The upper terminal part 7 supports a cylinder 11 of insulating material carrying, on its outside, a blowout coil 5 and, on its inside, a cylinder 12. Cylinder 12 comprises an insulating portion **12*a* and a conducting portion 12*b*. The fixed electrode 1 is also secured to the upper terminal part 7. Electrode 1 comprises a conducting portion 1*a* and an insulating 1*b*. Part 7 is electrically connected to one end of coil 5 through a line 16 and an opposite end of coil 5 is connected to portion 12*b* of cylinder 12**.

Lower terminal part 9 supports a compression cylinder 13. The movable electrode 2 which, to effect the disconnection, is pulled downwardly by the driving mechanism 20, serves at the same time as a compression piston. Part 9 with cylinder 13 forms a compression chamber 3 that is closed by piston portion **2*a* of electrode 2. Chamber 3** is filled with an arc quenching gas, such as $SF_6$.

With the switch in on-position (FIG. 1), the current flows through terminal part 7, the upper portion of fixed electrode 1, a contact ring 6, the lower portion of electrode 1, and movable electrode 2 to the lower terminal part 9 which is electrically connected thereto. Coil 5 is not in the circuit in this position of switch 50.

To switch-off or open switch 50, movable electrode 2 is pulled downwardly (FIG. 2). Thereby, contact ring 6 is also moved downwardly, since it is mechanically connected to movable electrode 2 through a tube 8 of insulating material. In this position, the current flows through terminal part 7, line 16, coil 5, portion 12*b*, contact ring 6, fixed electrode 1, the arc 14, and movable electrode 2, to terminal part 9.

Due to its displacement in compression space 3, the quenching gas flows through annularly distributed bores 4 (one of which is shown) and is blown into the arc 14 which is sustained between electrodes 1, 2. By the effect of the magnetic field of coil 5, the arc is set into rotary motion and extinguishes when the current passes through zero. The gases produced during the switching operation escape through bores 15 (one of which is shown).

While a specfic embodiment of the invention has been shown and described in detail to illustrate the application of the principles of the invention, it will be understood that the invention may be embodied otherwise without departing from such principles.

What is claimed is:

1. A power switch in which an arc is produced in an arc area comprising, a fixed electrode having an annular end portion, a movable electrode having a contact portion for engagement with the annular end portion of said fixed electrode and a projecting portion which extend into the annular end portion of said fixed electrode, said movable electrode being mounted for movement co-axially of said fixed electrode into a position contacting the annular end portion of said fixed electrode and into an open position spaced from the fixed electrode still co-axial therewith, with the projecting portion of said movable electrode forming with the annular end portion of said fixed electrode an annular arc area, switch opening means connected to said movable electrode for moving said movable electrode between said contact and open positions, means defining an arc quenching compression chamber for containing an arc quenching gas associated with said movable electrode, said movable electrode including a piston portion movable into said compression chamber for displacing the gas therein, said means defining said compression chamber including a plurality of gas flow passages for directing gas displaced from said compression chamber transversely across said annular arc area and transversely across an arc formed therein, and magnetic field means associated with said fixed and movable electrodes disposed co-axially of the annular arc area for producing a magnetic field in said annular arc area when the power switch is opened to cause rotation of an arc formed in said arc area between said fixed and movable electrodes.

2. A power switch in which an arc is produced in an arc area comprising, a fixed electrode, a movable electrode movable into a contact position contacting the fixed electrode and into an open position spaced from the fixed electrode, the space between said fixed and movable electrodes forming an annular arc area, switch opening means connected to said movable electrode for moving said movable electrode between said contact and open positions, means defining an arc quenching compression chamber for containing an arc quenching gas associated with said movable electrode, said movable electrode including a piston portion movable into said compression chamber for displacing the gas therein, said means defining said compression chamber including at least one gas flow passage for directing gas displaced from said compression chamber across said annular arc area, magnetic field means associated with said fixed and movable electrodes for producing a magnetic field in said annular arc area when the power switch is opened to cause a rotation of an arc formed in said arc area between said fixed and movable electrodes, a contact ring electrically insulated from and mechanically connected to said movable electrode and movable therewith, and an upper terminal connected to said fixed terminal through said contact ring when the switch is closed, said magnetic field means comprising a coil, said coil connected between said upper terminal and said fixed electrode through said contact ring when said contact ring is moved with said movable electrode to open the switch.

3. A power switch according to claim 2 further including an insulating tube connected between said movable electrode and said contact ring.

4. A power switch in which an arc is produced in an arc area comprising, a fixed electrode, a movable electrode movable into a contact position contacting the fixed electrode and into an open position spaced from the fixed electrode, the space between said fixed and movable electrodes forming an annular arc area, switch opening means connected to said movable electrode for moving said movable electrode between said contact and open positions, means defining an arc quenching compression chamber for containing an arc quenching gas associated with said movable electrode including a piston portion movable into said compression chamber for displacing the gas therein, said means defining said compression chamber including at least one gas flow passage for directing gas displaced from said compression chamber across said annular arc area, magnetic field means associated with said fixed and movable electrodes for producing a magnetic field in said annular arc area when the power switch is opened to cause a rotation of an arc formed in said arc area between said fixed and movable electrodes, said fixed electrode comprising a lower cylindrical member of conductive material and an upper cylindrical member of insulating material, an upper terminal connected to said upper cylindrical member of said fixed electrode, a contact ring mechanically connected to said movable electrode and movable therewith, said contact ring connected between said upper terminal and said lower cylindrical member of said fixed contact when said power switch is in its closed position, and an insulating tube connected between said movable contact and said contact ring.

5. A power switch according to claim 4 wherein said magnetic field means comprises a coil which is energized to produce said magnetic field through an arc produced in said arc area.

6. A power switch according to claim 4 wherein said upper cylindrical member of said fixed electrode includes at least one bore therethrough for venting gases from said annular arc area.

7. A power switch according to claim 4 wherein said gas flow passage comprises at least one bore in said insulating tube.

* * * * *